US009809951B1

(12) United States Patent
Wilson

(10) Patent No.: US 9,809,951 B1
(45) Date of Patent: Nov. 7, 2017

(54) JET TRENCHING SYSTEM

(71) Applicant: Michael W. N. Wilson, Aberdeenshire (GB)

(72) Inventor: Michael W. N. Wilson, Aberdeenshire (GB)

( * ) Notice: Subject to any disclaimer, the term of this patent is extended or adjusted under 35 U.S.C. 154(b) by 0 days.

(21) Appl. No.: 15/683,388

(22) Filed: Aug. 22, 2017

Related U.S. Application Data

(63) Continuation of application No. 14/976,909, filed on Dec. 21, 2015, now Pat. No. 9,745,716.

(51) Int. Cl.
*E02F 5/28* (2006.01)
*E02F 5/00* (2006.01)
*E02F 9/20* (2006.01)

(52) U.S. Cl.
CPC ..... *E02F 5/287* (2013.01); *E02F 5/006* (2013.01); *E02F 9/2004* (2013.01); *E02F 9/205* (2013.01)

(58) Field of Classification Search
CPC ..... E02F 3/9206; E02F 5/006; E02F 5/287; E21B 7/185; E21B 7/205
USPC ..... 37/307, 344, 309; 405/163
See application file for complete search history.

(56) References Cited

U.S. PATENT DOCUMENTS 3,576,111 A 4/1971 Henry, Jr.
3,638,439 A 2/1972 Niederer
3,877,237 A 4/1975 Norman
3,926,003 A 12/1975 Norman
4,091,629 A 5/1978 Gunn et al.
4,114,390 A 9/1978 Van Steveninck et al.
4,154,551 A 5/1979 Petrie
4,295,757 A 10/1981 Gaspar
4,575,280 A 3/1986 Hemphill et al.
4,787,777 A 11/1988 Harmstorf
5,288,172 A 2/1994 Reuhl
5,659,983 A 8/1997 Coutarel et al.
5,944,447 A 8/1999 Wyatt
5,970,635 A 10/1999 Wilmoth
6,273,642 B1 8/2001 Anderson
6,705,029 B2 3/2004 Anderson
6,719,494 B1 4/2004 Machin
9,745,716 B1 * 8/2017 Wilson ..... E02F 5/287

FOREIGN PATENT DOCUMENTS

GB 2006302 5/1979
GB 2049094 12/1980
WO 0218717 3/2002

* cited by examiner

*Primary Examiner* — Gary Hartmann
(74) *Attorney, Agent, or Firm* — Frank J. Catalano; Gable Gotwals

(57) ABSTRACT

A jetting system for an undersea trencher has jetting conduits extending aftward of its trench-cutting jetting swords. Jetting conduit nozzles direct liquid radially from their jetting conduits into the trench after the trench is excavated by the jetting sword cutting nozzles. The jetting conduits direct sufficient liquid into the trench to maintain the mix of trenched soil and water in the trench along the length of the conduits at not more than a super-critical density.

3 Claims, 7 Drawing Sheets

JET TRENCHING SYSTEM

CROSS REFERENCE TO RELATED APPLICATIONS

This application is a continuation claiming priority to U.S. patent application Ser. No. 14/976,909, filed Dec. 21, 2015.

BACKGROUND OF THE INVENTION

This invention relates generally to the subsea burial of products such as pipelines, umbilicals and power cables and more particularly concerns the use of jetting systems to bury and protect these products in soft and loose materials, such as soft and medium stiffness clays and in sands and silts.

In most conventional jetting systems, one or more high-pressure water-jetting swords are used to excavate a trench. The jetting creates a mix of water and excavated soil and, assuming continuance of a super-critical density of the resulting mix, the product will fall by gravity to the trench floor.

However, as the mix of water and soil begins to settle, its density increases and descent of the product gradually slows. At critical density product descent ceases, often significantly before the product has reached the floor of the trench. In the sub-critical density range that follows, the settling soil solidifies under and around the stabilized product. The product never reaches its desired depth in the trench.

Also, while the pipelines, umbilicals and power cables buried using jetting system techniques do have inherent stiffness, they tend to bend under their own weight to natural minimum bend radii exceeding two meters. The greater the bending radii, the longer the time required for the product to reach the desired depth and the greater the likelihood that reaching critical density will occur before the product reaches the trench floor.

A common response to the critical density dilemma is the use of expensive, very-high-powered jetting systems, consuming as much as two megawatts of power, in an effort to increase the speed of advance of the jetting system along the product path, allowing the product to fall to the trench bottom more rapidly. This is somewhat palatable given that increased trenching speeds reduce total trenching time. But, while maximum trenchers speeds are desirable, there are many factors which, alone or in concert, limit the possibilities of increasing, and may even result in decreasing, trenching speeds in any specific application.

Furthermore, in hard soils and gravels, the jets take significant time to do their work. En route variations in the soil quality, such as mixed soils with different super-critical and sub-critical properties, soils that are both horizontally and vertically stratified, changes in the types of soil and competent soils supporting the products ahead of the jetting swords, all complicate maximizing trenching speed. Maximum speeds of the trencher tracks, the power available to the tracks and the water power available to the system all cap the possible trenching speed. For any or all of these reasons, achievement of sufficient speed to permit backfill at super-critical density cannot be assured with known jetting systems.

Known alternatives to the increasing-trenching-speed solution include the use of multiple passes of the jet system to lower the product in stages, the use of suction devices to remove the water and soil mix from the trench and directing some of the jets of the swords backwards to keep the water and soil mix at as low a density as possible. Multi-pass systems increase time and cost. Adding devices increases cost and complexity. Redirecting jets diminishes the cutting forces applied by the system and slows progress along the product path.

Other problems with presently known jetting systems include their mass which is typically in a range of 15,000 kg and requires sophisticated launch and recovery equipment, their high sensitivity to weather, their reliance on delicate equipment which makes repair difficult and time consuming, and their multiple lift lines, hoses and control umbilicals which can lead to entanglement with, and loss of control of, the trencher.

It is, therefore, an object of this invention to provide a jetting system which maintains the water and soil mix at a super-critical density for longer distances behind the jetting swords. Another object of this invention is to provide a jetting system which facilitates rapid descent of the product in the trench. It is also an object of this invention to provide a jetting system which increases the likelihood of the product reaching its desired depth in the trench. A further object of this invention is to provide a jetting system which permits the advance of the jetting system along the product path at lower speeds. And it is an object of this invention to provide a jetting system which reduces the need for multiple passes of the jetting system to lower the product in stages, suction devices to remove the water and soil mix from the trench and/or redirection of some of the jets of the swords backwards to keep the water and soil mix at as low a density as possible.

SUMMARY OF THE INVENTION

In accordance with the invention, a jetting system for an undersea trencher has a chassis with one or more jetting swords extending downward from chassis. Liquid under pressure is applied to the jetting swords. A jetting conduit extends aftward from at least one of the jetting swords. Each jetting conduit receives liquid under pressure, preferably from its sword but possibly from another source. A plurality of nozzles displaced along the length of each jetting conduit redirect the liquid radially into the trench being excavated by the jetting swords. Preferably, joints connecting the swords and corresponding conduits articulate in a vertical plane.

The joints may be remotely controlled. The conduits may be flexible or rigid with at least one articulating joint in the conduit. Each of the conduit joints may independently articulate in either/or horizontal and vertical planes and may be remotely controlled. The jetting conduits, taken together, direct sufficient liquid into the trench to maintain a mix of trenched soil and water in the trench along the length of the conduits at not more than a super-critical density.

Each jetting conduit may be configured to define a vertical frame. The height of each frame extends from a first longitudinal axis through a lower end of its corresponding sword to a second longitudinal axis through an upper portion of its corresponding sword. The length of each frame is predetermined to maintain the mix of trenched soil and water of the in the portion of the trench commensurate with the frame length at not more than a super-critical density. In the case of a two sword system, a member may space the trailing ends of the frames at a distance substantially equal to the space between the swords. Opposing side walls may be defined by the opposing frames. A top wall may be defined by aft portions of opposed upper trailing portions of the frames.

BRIEF DESCRIPTION OF THE DRAWINGS

Other objects and advantages of the invention will become apparent upon reading the following detailed description and upon reference to the drawings in which.

While the invention will be described in connection with a preferred embodiment thereof, it will be understood that it is not intended to limit the invention to those embodiments or to the details of the construction or arrangement of parts illustrated in the accompanying drawings.

DETAILED DESCRIPTION

Known Jetting Trenchers

Figure 1:
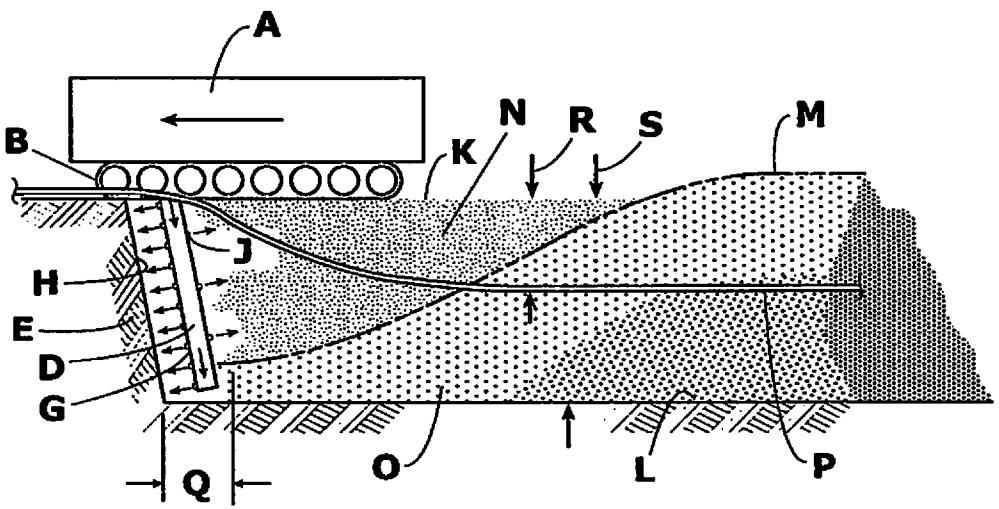
Fig. 1 ( PRIOR ART )
FIG. 1 is a diagrammatic front elevation presentation of a typical known jetting system taken in a plane transverse to a trenching path.
Figure 2:
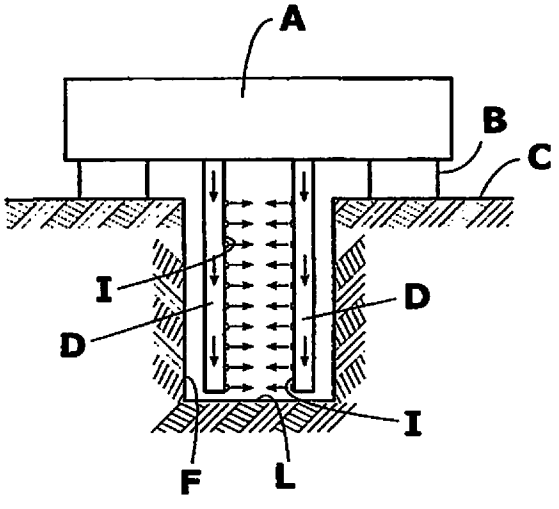
Fig. 2 ( PRIOR ART )
FIG. 2 is a diagrammatic side elevation presentation of the jetting system of FIG. 1 taken in a vertical plane parallel to the trenching path and illustrating a typical super-critical to sub-critical degradation of water and soil mix afforded by the known jetting system.

Looking first at FIGS. 1 and 2, a typical known trencher A has tracks B riding on the seabed C and one or more, and as shown a pair, of downwardly depending jetting swords D which excavate the soil E forward of the swords D to create a trench F trailing the swords D. Some known trenchers ride on skis or rely on buoyancy principles for support. Typically, the excavated soil consists of varying quantities of soft and loose materials, such as soft and medium stiffness clays and sands and silts.

As shown, the swords D are inclined aftward below the trencher A. Their angle of inclination may be variable to permit changes in the attack angle of their nozzles during trenching and/or to adjust the trench depth reached by the swords D. The swords D may also be retractable and extendable during trenching to permit variation of the trench depth.

Forward nozzles G are oriented in the jetting swords D to jet high volumes of water at high pressure in a forward direction and cut the leading end H of the trench F. Transverse nozzles I may be oriented in the jetting swords D to jet water toward their opposite swords D and maintain spacing of the swords D during trenching. Aft nozzles J may be oriented in the jetting swords D to jet water at lower pressure into the mix K and maintain its density immediately trailing the swords D.

Looking at FIG. 2, as the swords D advance, product P passes between the swords D into the excavated trench F. Immediately, or at best almost immediately, after the mix K is received in the trench F, the excavated soil E begins to descend toward the trench floor L. As the excavated soil E further aft of the swords D descends closer and closer to the trench floor L, the density of the mix K below the product P increases and the rate of descent of the product P toward the trench floor L decreases. Gradually, the density of the mix K below the product P may increase to a critical density M, being the density at which further descent of the product P toward the trench floor L is impossible. Ultimately, the settling soil E will reform into its pre-trenched state. Considering critical density M as a threshold, the range of mix densities less than the critical density M is super-critical N and the range of mix densities greater than the critical density M is sub-critical O.

Continuing to look at FIG. 2, in a trench F excavated by known jetting trenchers A, critical density M is reached at a relatively short distance Q aft of the jetting swords D. Therefore, the product P is less likely to have sufficient time of descent at super-critical densities N to reach the floor L of the trench F. Frequently, the depth R of the buried product P may be significantly shallower than the depth S of the excavated trench F. Also, depending on the variations of soil composition along the length of the trench F, the burial depth R of the product P in the trench F may be quite irregular.

The Present Jetting Trencher

Figure 4:
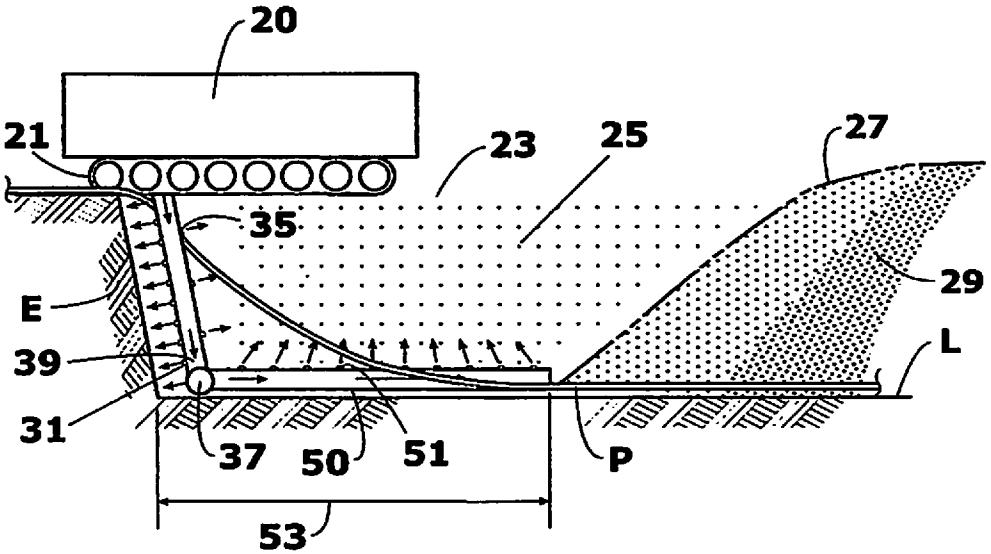
FIG. 4 is a diagrammatic side elevation presentation of the jetting system of FIG. 3 taken in a vertical plane parallel to the trenching path and illustrating a typical super-critical to sub-critical degradation of water and soil mix afforded by the jetting system.
Figure 3:
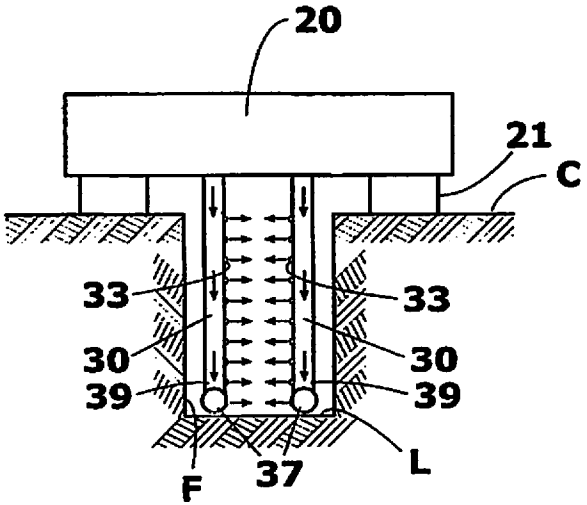
FIG. 3 is a diagrammatic front elevation presentation of a jetting system in accordance with the invention taken in a plane transverse to a trenching path.

Turning now to FIGS. 3 and 4, a trencher 20 in accordance with the present invention may be, but is not necessarily, the same as known trenchers in many ways. It may have tracks 21 or skis riding on, or may be buoyantly supported above, the seabed C. It may have one or more, and as shown a pair, of downwardly depending jetting swords 30 excavating the soil E forward of the swords 30 to create a trench F trailing the swords 30. It may also, but does not necessarily, jet high volumes of water at high pressure transversely toward their opposite swords 30 and water at lower pressure aftward into the mix 23. Remotely controlled valves (not shown) may also be provided to divide the flow to each sword 30 into forward 31, transverse 33 and aft 35 discharge nozzles, depending on the needs of the forward, trench-cutting nozzles 31. Those of ordinary skill in the art know that any structure protruding into the product path must be sufficiently shrouded to protect the product against contact with non-smooth surfaces, and that principle applies as well to the present disclosure.

However, looking at FIGS. 3-6, the present trencher 20, unlike known trenchers, has a joint 37 at the low end 39 of each jetting sword 30 and a jetting conduit 50 extending aftward of each joint 37. As shown, the jetting conduit 50 is riding along the trench floor L and water at high pressure is delivered by each sword 30 through its low joint 37 into an inlet end 75 of its jetting conduit 50.

As best seen in FIG. 4, each jetting conduit 50 has nozzles 51 along its length jetting high volumes of water at high pressure into the mix 23. Thus, the super-critical density 25 of the mix 23 is maintained for a considerably greater distance aft of the jetting swords 30 than was possible with known jetting trenchers. The extended distance 53 gives the descending product P greater time in super-critical density mix 25 to reach the floor L of the trench F.

Jetting Conduits

Figure 5:
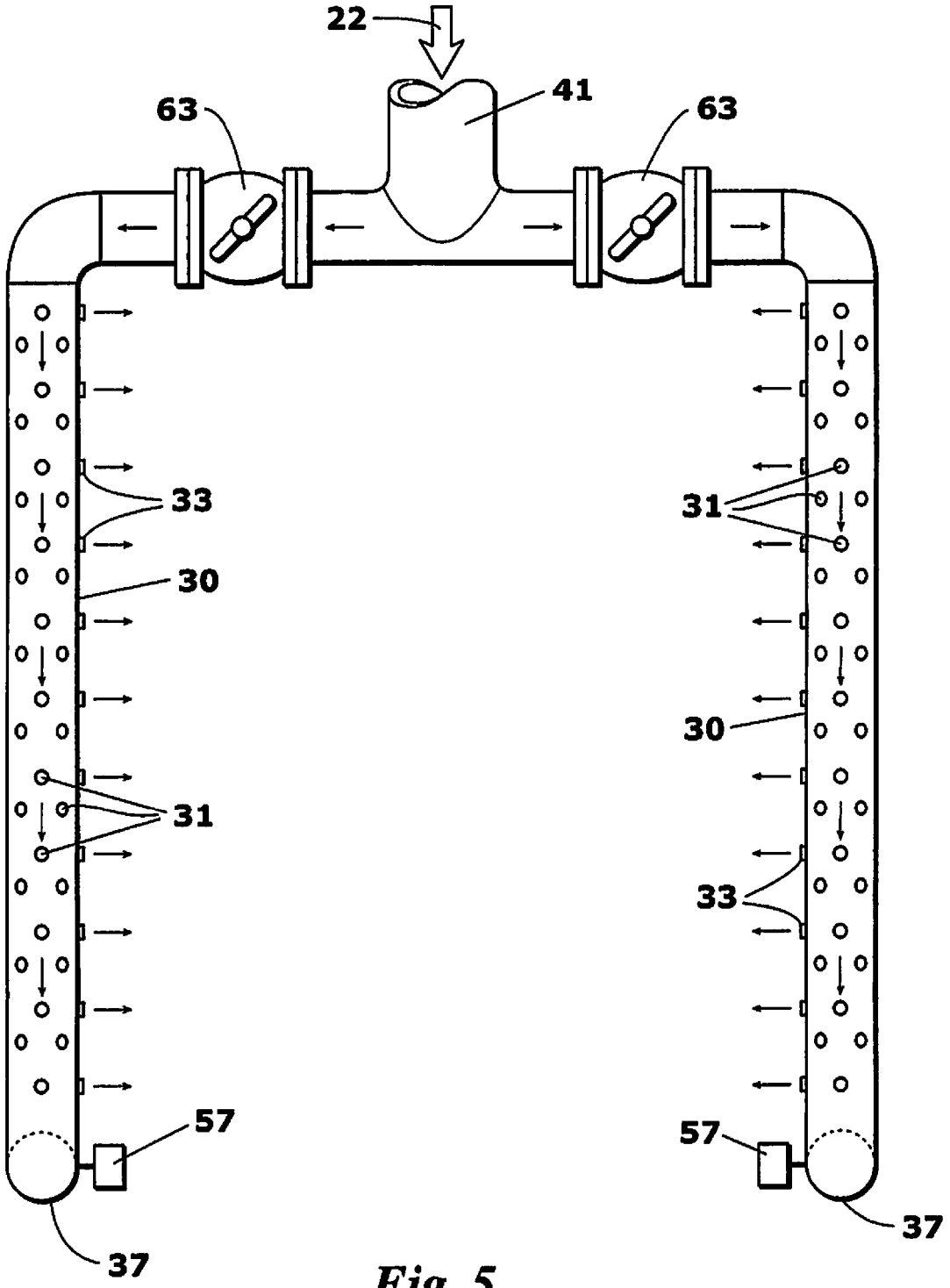
FIG. 5 is a front elevation view of a two-sword jetting system in accordance with the invention.
Figure 6:
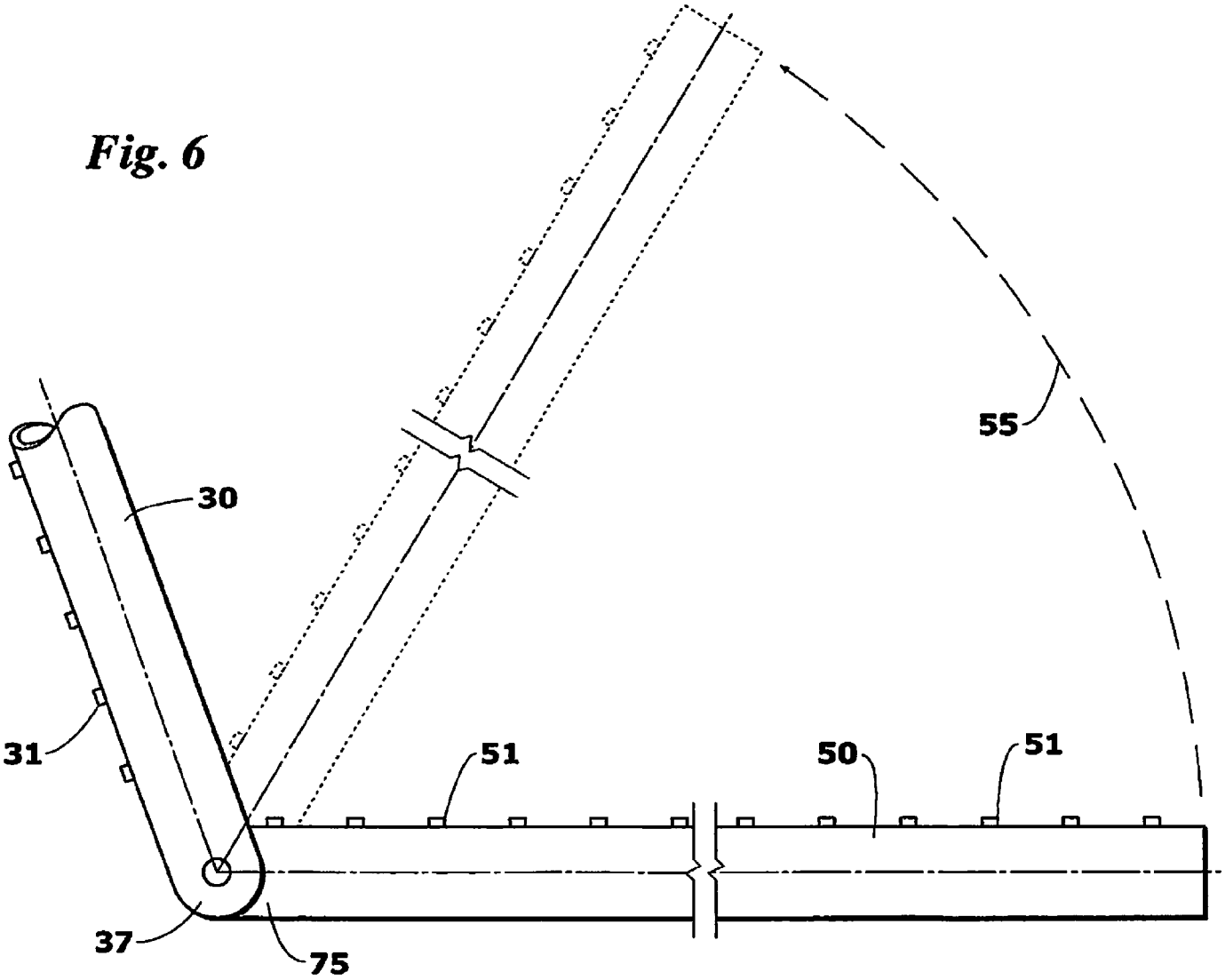
FIG. 6 is a side elevation view of a jetting sword and a jetting conduit connected in accordance with the present invention and in a deployed condition.

As seen in FIGS. 5 and 6, the joints 37 connecting the jetting conduits 50 and their respective jetting swords 30 are unidirectional and, in the absence of water pressure, free to articulate in response to the environment of the jetting conduit 50 but, when water pressure is applied, permitting the jetting conduit 50 to rotate to the fullest extension within the range permitted by the joint 37. Alternatively, the joints 37 can be independently articulated by hydraulically controlled actuators 57. Thus the joints 37 can be freely or remotely operated to cause the jetting conduits 50 to rotate in a vertical plane between a trenching condition 59 and a stowed condition 61, as illustrated by solid and dashed lines, respectively, in FIG. 6. Hydraulics for actuator control can be derived from the trencher high pressure water supply system, from the track drive system or from other available hydraulic supply.

The jetting swords 30 may be independently supplied with water under high pressure or, as seen in FIG. 5, a single supply line 41 from the source of water under high pressure can be independently connected to the jetting swords 30 through corresponding remotely controlled valves 63. Those of ordinary skill in the art know that a jetting sword may be configured to include multiple pipes, allowing different pressures and flows in different parts of the swords, and those principles apply as well to the presently disclosed jetting swords 30 and jetting conduits 50. For example, it is likely that pressures and flows in jetting conduits will be different from pressures and flows in the forward cutting nozzles of the jetting swords.

Looking at FIGS. 7-10, the jetting conduit 50 seen in FIG. 6 may consist of multiple rigid segments 65 serially connected by universal and/or unidirectional joints 67 and 69, respectively. The universal joints 67 permit multidirectional articulation, at least in vertical and horizontal planes, of their respective conduit segments 65 while the unidirectional joints 69 permit articulation of their respective segments 65 only in the vertical plane. Remotely controlled hydraulically operated actuators may be used to independently articulate their respective joints 67 and 69.

Figure 8:
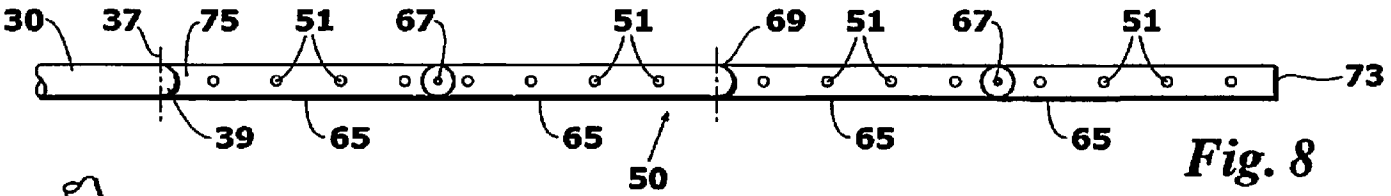
FIG. 8 is a plan view of the rigid, hinged-segment jetting conduit of FIG. 7.
Figure 7:
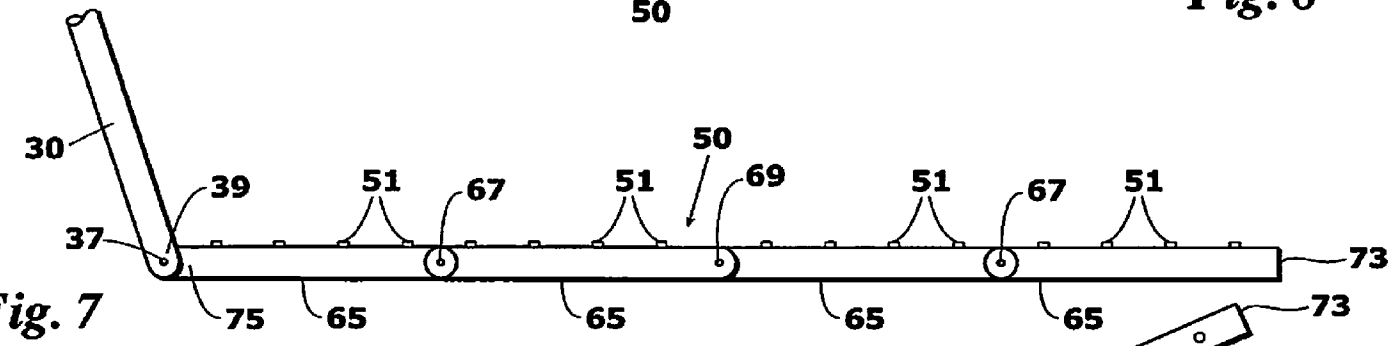
FIG. 7 is a side elevation view of a rigid, hinged-segment jetting conduit in axially longitudinal alignment.

In FIGS. 7 and 8, the sword-to-conduit joint actuator 57 shown in FIG. 6 has been operated to horizontally align the leading segment 65 of the jetting conduit 50 from the low end 39 of its sword 30. The trailing segments 65 will follow the path of the leading segment 65 unless the contour of the trench F dictates otherwise or one or more joints 67 and 69 is actuated to control the degree of articulation 55 between sequential segments 65. As shown in FIGS. 7 and 8, the entire jetting conduit 51 is in straight horizontal alignment.

Figure 9:
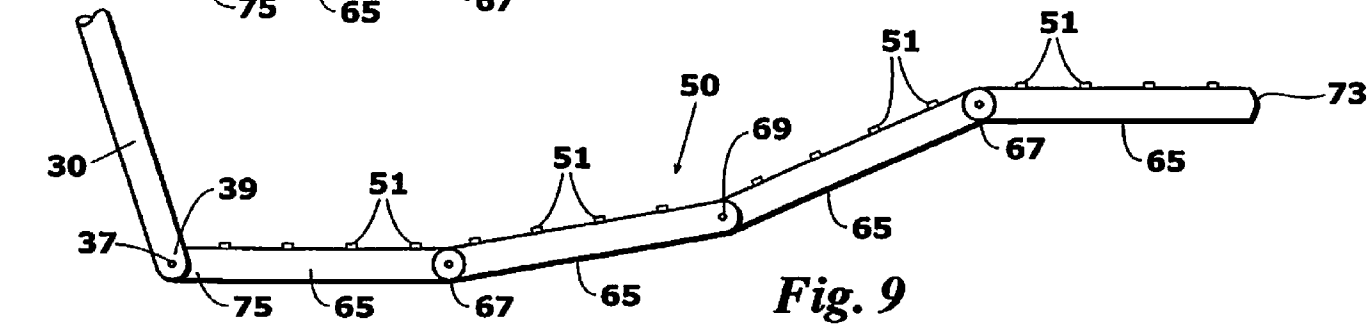
FIG. 9 is a plan view of the rigid, hinged-segment jetting conduit of FIG. 7 in a bend-trenching application.

In FIG. 9, the sword-to-conduit joint actuator 57 shown in FIG. 6 has been operated to horizontally align the leading segment 65 of the conduit 50. The trailing segments 65 have been articulated in a vertical plane in response to the depth contour of the trench and/or actuation of one or more of the universal and unidirectional joints 67 and 69.

Figure 10:
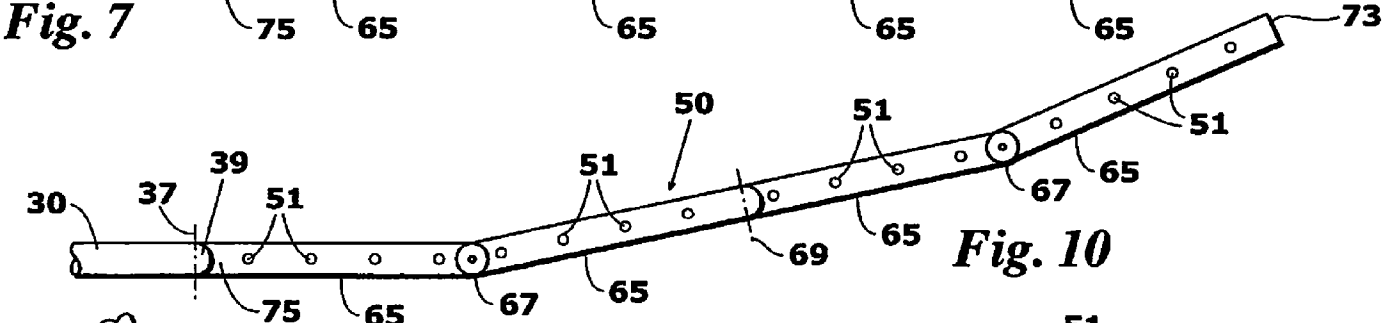
FIG. 10 is a side elevation view of the rigid, hinged-segment jetting conduit of FIG. 7 in a variable-depth application.

In FIG. 10, the sword-to-conduit joint actuator 57 shown in FIG. 6 has been operated to horizontally align the leading segment 65 of the conduit 50. The trailing segments 65 have been articulated in a horizontal plane in response to the bending contour of the trench F and/or actuation of one or more universal joints 67.

The numbers of segments 65 and types of connecting joints 67 and 69 can be varied to accommodate most anticipated trench contours in a given trenching application.

Figure 11:
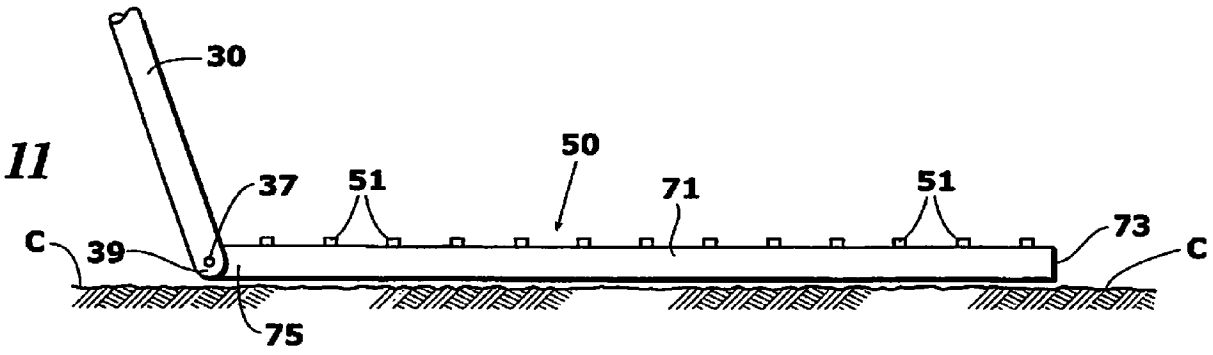
FIG. 11 is a side elevation view of a unitary flexible jetting conduit disposed on the seabed.
Figure 12:
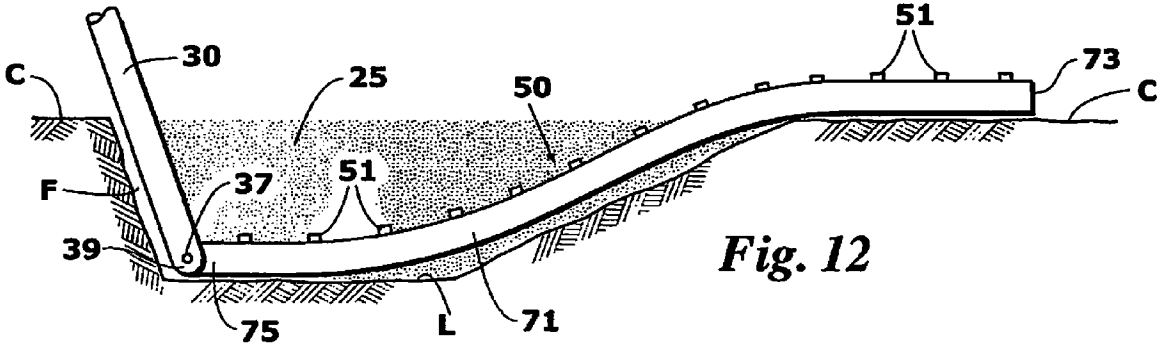
FIG. 12 is a side elevation view of the unitary flexible jetting conduit of FIG. 11 in transition from seabed to trench floor.
Figure 13:
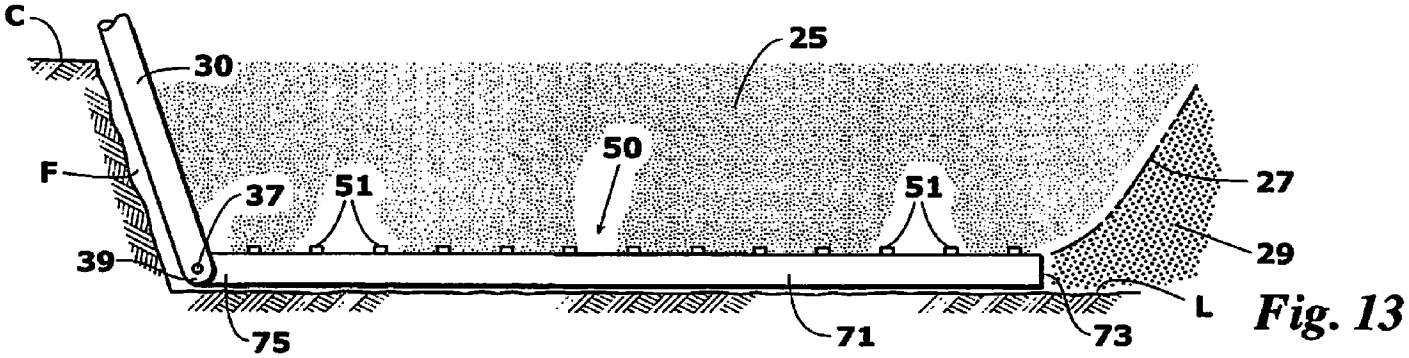
FIG. 13 is a side elevation view of the unitary flexible jetting conduit of FIG. 11 disposed on the trench floor.

Alternatively, looking at FIGS. 11-13, the jetting conduit 50 of FIG. 6 might consist of a length of flexible tubing 71 capable of conforming to the path defined by the trench F as it is being excavated by the trencher 20. In FIG. 11, before the rigid sword 30 begins to excavate the trench F, the flexible tubing 71 trails the lower end 39 of its rigid sword 30 and travels on the seabed C. In FIG. 12, as the rigid sword 30 begins to excavate the trench F, the flexible tubing 71 trailing the low end 39 of its rigid sword 30 transitions in the super-critical density mix 25 from the seabed C to the trench floor L. In FIG. 13, once the trench F is longer than the flexible tubing 71, the entire length of tubing 71 will generally contour to the trench floor L, depending on the degree of its flexibility and the contour of the floor L. The length of the jetting conduit 50 will maintain the super-critical density 25 of the mix for at least the length of the product P which is commensurate with the length of the tubing 71. Preferably, if flexible tubing 71 does serve as the jetting conduit 50, the selected flexibility will be sufficient to allow the conduit 50 to conform to the anticipated contours of the trench F.

Figure 15:
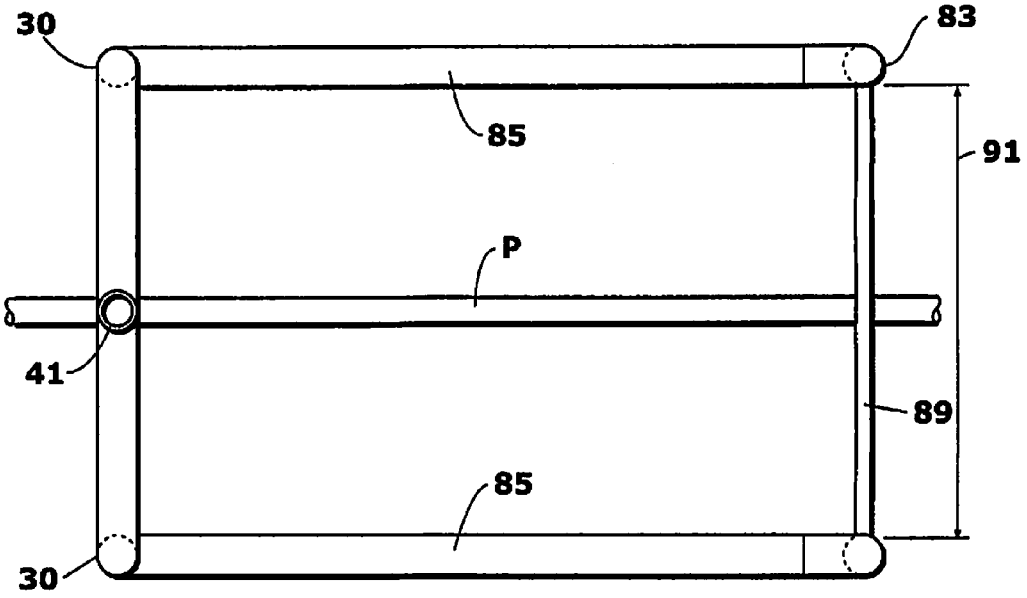
FIG. 15 is a top plan view of the rigid frame jetting conduit of FIG. 14.
Figure 14:
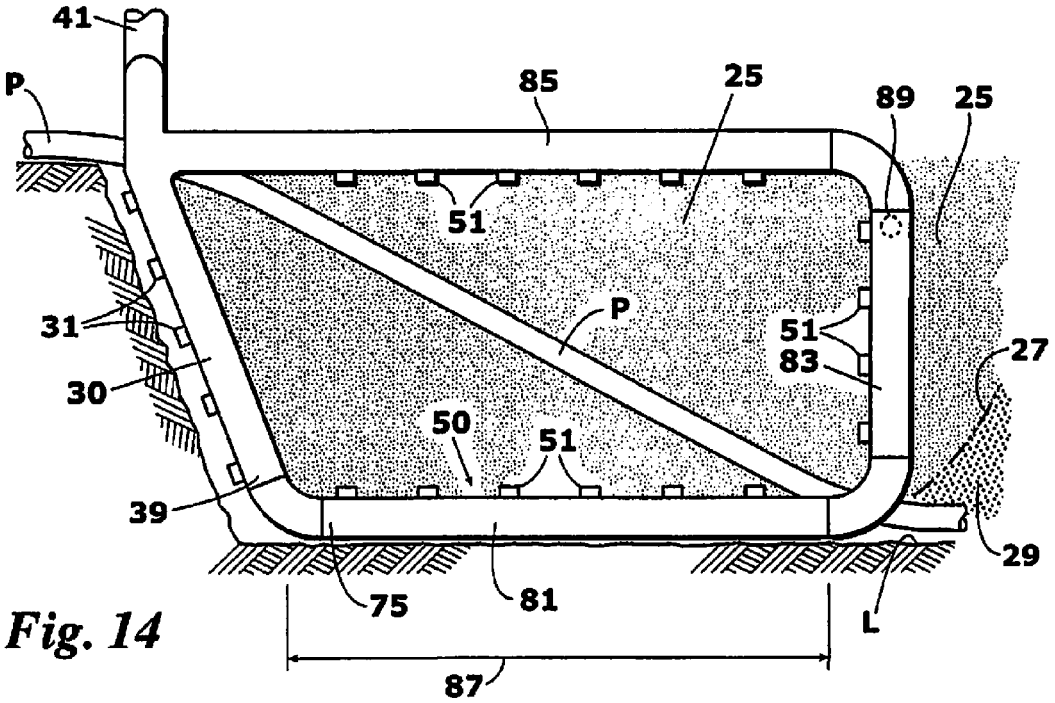
FIG. 14 is a side elevation view of a rigid frame jetting conduit.

Turning now to FIGS. 14 and 15, the jetting conduit 50 of FIG. 6 forms a rigid frame 80 defining the volume of mix to be maintained at super-critical density 25. Each sword 30 has a rigid jetting conduit frame 80 which extends horizontally 81 aftward from the lower end 39 of its sword 30, upwardly 83 to the level of the upper end 43 of its sword 30 and horizontally 85 to the upper end 43 of its sword 30. Preferably, the length 87 of its aftward extension 81 is at least the length of the desired volume of super-critical density mix 25 to be maintained. Jetting nozzles 51 can be located anywhere along the entire length 81, 83, 85 of the jetting conduit 50.

One or more transverse members 89 may be mounted between the upper horizontal 85 and aft vertical 83 portions of the jetting conduits 50 of opposed jetting swords 30 to maintain the space 91 between their respective jetting conduits 50 substantially the same as the space between the swords 30. The members 89 must be configured and located so that the product P will pass between the swords 30 and below the spacing members 89. A sidewall may be provided in the area defined by each of the rigid frame jetting conduits 81, 83, 85 to prevent decomposition of the sides of the trench F by the jetting of the nozzles 51 and also to prevent loosened soil along the sides of the trench F from penetrating and increasing the density of the super-critical mix 25. A top wall may also be provided so long as the front top area through which product P must pass remains unobstructed.

Regardless of whether rigid or flexible jetting conduit 50 is used, the free end 73 of a jetting conduit 51 may be open, closed (as shown) or controlled by a remotely operated shutoff valve. If, for example, during trenching, a need for greater length of super-critical mix 25 arises, a capped conduit end might be opened to meet the need. Whether rigid or flexible, the jetting conduit 50 may be made of any suitable material, metal or plastic, provided the strength and flexibility of the resulting conduit 50 is suited to the necessities of the particular trenching application. Steel conduit may have sufficient elasticity for the bends required in some applications while plastic conduit may have sufficient rigidity for other applications.

Nozzles for jetting swords are well known and can be used for the jetting conduits 50. The nozzles 51 of the jetting conduits 50 are typically independently angled to flow water upwards and towards the opposite trench wall, preferably directed toward the center of the desired volume of the super-critical density mix 25. However, the number, size, spacing and discharge vectors of the nozzles 51 can be empirically determined to suit the particular trenching application. The high pressure water discharge of the jetting conduits 50 will serve to keep the trench F open, maintain the mix 23 of water and excavated soil at super-critical densities 25 for greater lengths and also sustain the separation of the lower ends 39 of the swords 30.

If the source 22 of water at high pressure is connected to the trencher 20 by high strength flexible hose, the hose can also serve as the trencher lift line. It is further anticipated that the trencher 20 can be served by a detachable remote operating vehicle (ROV) and, therefore, be launched and retrieved via a chute or stern roller of a relatively small transporting vessel, reducing greatly the cost of the launch and recovery system (LARS). Assuming the availability of a suitable flexible jetting conduit 50, chute or stern roller launch and recovery might be achieved without need for an articulating joint 37 between the jetting sword 30 and the jetting conduit 50. It is also anticipated that high strength flexible hose can be employed as the launch and recovery lines. Reducing the number of lift, launch and recovery lines serving the trencher 20 reduces the risks of entanglement and loss of control.

Thus, it is apparent that there is been provided, in accordance with the invention, an improved jetting system that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly it is intended to embrace all such alternatives, modifications and variations as fall within the scope of the appended claims.

What is claimed is:

1. For maintaining mix in an undersea trench being dug by a jet trencher below critical density during descent of a pipe/cable toward a bottom of the trench, a method comprising the steps of:

supplying liquid under pressure to at least one jetting conduit aligned and traveling aftward of the trencher along the bottom of the trench: and discharging the liquid under pressure received in the at least one jetting conduit radially from the at least one jetting conduit at intervals along the length of the at least one jetting conduit into the trench.

2. A method according to claim 1, said step of discharging the liquid under pressure received in the at least one jetting conduit radially from the at least one jetting conduit at intervals along a length of the at least one jetting conduit into the trench comprising discharging sufficient liquid under pressure into the trench to maintain a mix of trenched soil and water along the length of the at least one jetting conduit at not more than a super-critical density.

3. A method according to claim 1, said step of discharging the liquid under pressure received in the at least one jetting conduit radially from the at least one jetting conduit at intervals along a length of the at least one jetting conduit into the trench comprising directing the radial discharge from the at least one jetting conduit toward the geometric center of the trench.

* * * * *